United States Patent [19]

Timmer

[11] 4,253,616

[45] Mar. 3, 1981

[54] GARBAGE DISPOSAL DRAIN PROTECTOR

[76] Inventor: Dana W. Timmer, 865 Buena Vista Rd., Santa Barbara, Calif. 93108

[21] Appl. No.: 35,915

[22] Filed: May 4, 1979

[51] Int. Cl.[3] ..... B02C 18/40

[52] U.S. Cl. ..... 241/46 B; 209/235; 241/100.5; 241/257 G

[58] Field of Search ..... 241/46 A, 46 B, 46 R, 241/46.04, 46.17, 100.5, 32.5, 257 G; 209/233, 235, 352, 370, 374; 4/187 R, 189, 190, 197, 286, 288, 290, DIG. 4, DIG. 19

[56] References Cited

U.S. PATENT DOCUMENTS 4,089,474 5/1978 Timmer ..... 241/46 B

*Primary Examiner*—Mark Rosenbaum

*Attorney, Agent, or Firm*—Edward J. DaRin

[57] ABSTRACT

A garbage disposal drain protector adapted to be readily secured, in a few seconds, to all commercially available garbage disposal units. The disposal drain protector is mounted adjacent the open end of the disposal to catch silverware or the like that may inadvertently enter the disposal to prevent these objects from being subjected to the cutting blades of the disposal and permits them to be manually retrieved, intact, from the drain protector. The general function is the same as that provided by the device disclosed in U.S. Pat. No. 4,089,474.

16 Claims, 6 Drawing Figures

GARBAGE DISPOSAL DRAIN PROTECTOR

REFERENCE TO RELATED APPLICATIONS

This invention is an improvement over the garbage disposal drain protector disclosed in my U.S. Pat. No. 4,089,474, granted on May 16, 1978.

In my earlier U.S. Pat. No. 4,089,474, I disclosed a garbage disposal drain protector adapted to be secured in a commercially available garbage disposal unit for preventing silverware or the like from being accidentally swept into the unit and being subjected to the disposal cutting blades. The protective device is pivotally mounted to the disposal wall to catch silverware or the like, and may be pivoted out of position by manually inserting large objects into the unit so they may be disposed of readily and with the device returning to its normal position once the large object passes beyond the protective device.

The garbage disposal protective device disclosed in my aforementioned patent operates satisfactorily. The installation of the prior art protective device onto a disposal, however, is cumbersome and time-consuming. In order to install the garbage disposal drain protector that I have previously patented, it is required that the disposal be detached from the sink for installation purposes and that the disposal drain protector device be secured to the side wall of the disposal housing. Once the protective device is secured to the disposal housing, the disposal is once again connected to the sink. Despite the satisfactory operation of my prior disclosed device, some simpler and more economical universal means is required for attaching a drain protective device of the type disclosed in my patent to a garbage disposal.

SUMMARY OF THE INVENTION

My present invention provides a relatively inexpensive and simplified garbage disposal drain protector that allows the device to be installed in any commercially available garbage disposal in seconds without the need to resort to tools, screws or similar fastening elements. The device is so simply constructed that even a housewife can readily apply it to her disposal without any special instructions or knowledge. The attachment means that I have developed, allows the disposal protective device to be universally acceptable and readily mountable into all presently known commercially available garbage disposals despite the differences in the drain openings of the disposals of the different manufacturers. The entire protective device, including the mounting means, can be advantageously and inexpensively constructed of plastic, thereby eliminating any corrosion problems that may result from utilizing metallic elements or materials. In addition to the ease of manufacture and attachment to the garbage disposal, the improved garbage disposal drain protective device of the present invention inheres all of the advantages of the device disclosed in my above identified earlier granted U.S. patent.

From a structural standpoint, the present invention comprehends a protective device for a garbage disposal or the like, wherein the garbage disposal housing has an open end for receiving waste material to be disposed of by means of the disposal. The open end of the garbage disposal has an exposed flange extending inwardly of the open end a preselected distance. The garbage disposal protective device comprises an annular frame member having a plurality of spaced apart securing elements extending from one side thereof and adapted to secure the frame member to the disposal flange. The frame member includes a dependent arm extending therefrom from the same side as the frame securing elements and inclined toward the center of the frame member at a preselected angular relationship. The protective device includes guard means that is pivotally secured adjacent the free end of the dependent arm and is normally mounted in a plane substantially parallel to the plane of the disposal open end and extending adjacent the side walls of the housing and yet spaced therefrom to permit waste material to move through the space between the housing and the edge of the guard means. The guard means normally functions to trap utensils and similar large objects, or valuable objects such as rings, that inadvertently fall thereon, from moving through the disposal to the cutting blades thereof. The guard means is manually pivotable out of the path of large objects placed into the open end of the garbage disposal housing and moved against the guard element so as to pivot it out of its normal position to allow the object to be moved beyond the guard means to the cutting blades and when the guard means is released from a large object, it automatically pivots to its normal position.

These and other features of the present invention may be more fully appreciated when considered in the light of the following specification and drawings, in which.

Figure 1:
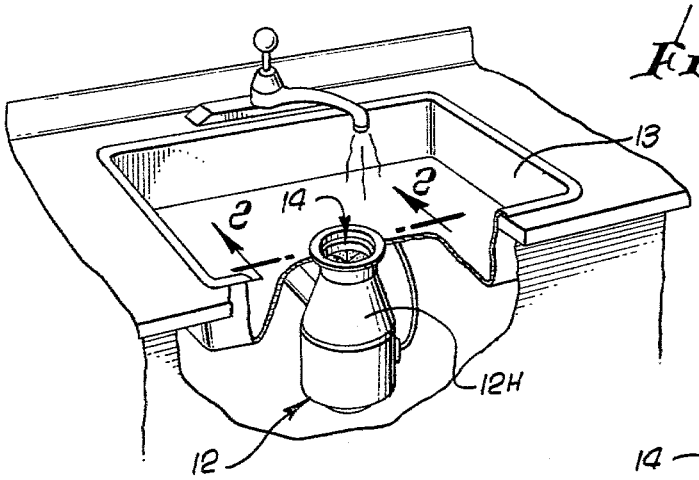
FIG. 1 is a perspective view, with portions broken away, of a garbage disposal unit mounted in a sink and embodying the the present invention.
Figure 2:
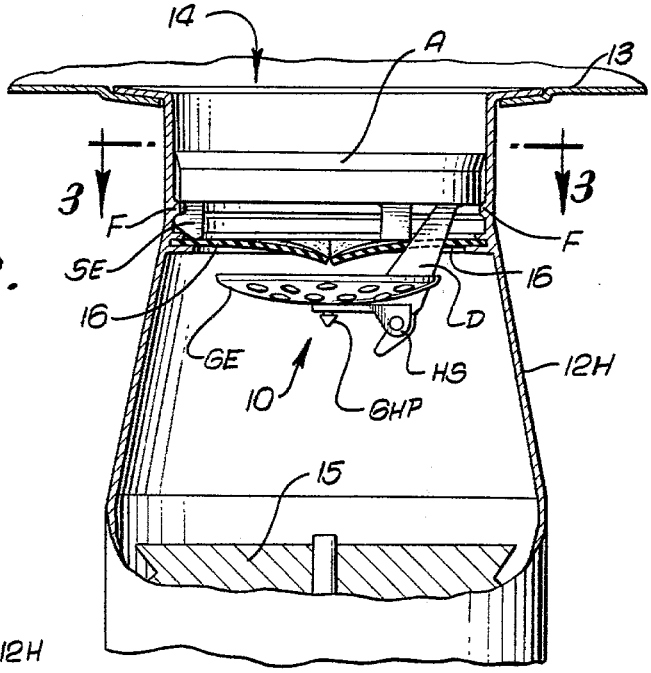
FIG. 2 is a cross-sectional view taken along the line 2—2 of FIG. 1.

Now referring to the drawings, the construction of the improved garbage disposal drain protector 10 of the present invention will be described. A conventional residential garbage disposal 12, as illustrated in FIG. 1, mounts beneath a sink 13 in alignment with the drain opening 14 for permitting food particles, scraps and small waste materials to be washed into the drain 14 and thereby into the disposal 12. A conventional garbage disposal unit 12 is generally provided with cutting blades 15 rotatably mounted in the garbage disposal unit for cutting up waste particles washed in or placed into the unit; see FIG. 2. The garbage disposal unit 12 generally has a slotted rubber flange 16 secured to the open end of the housing 12H for the garbage disposal unit so that it mounts just below the level of the drain 14, as can be best appreciated from examining FIG. 2. Each garbage disposal unit 12 is also usually provided with a flange F that is located immediately above the rubber flanges 16. These flanges F for the various commercially available garbage disposals 12 vary in internal diameter. This flange F is advantageously utilized in accordance with the concept of the present invention for mounting the disposal drain protector 10 of the present invention. The garbage disposal drain protective device 10 is secured to the flange F for the disposal unit 12 intermediate the open end thereof or the end having the flange F and the cutting blades 15 in a plane substantially parallel to the open end of the housing 12H. The garbage disposal drain protective device 10 is mounted sufficiently close to the open end of the sink drain 14 to catch silverware and similar large objects that may pass through the rubber flange 16, as illustrated in the drawings.

Figure 4:
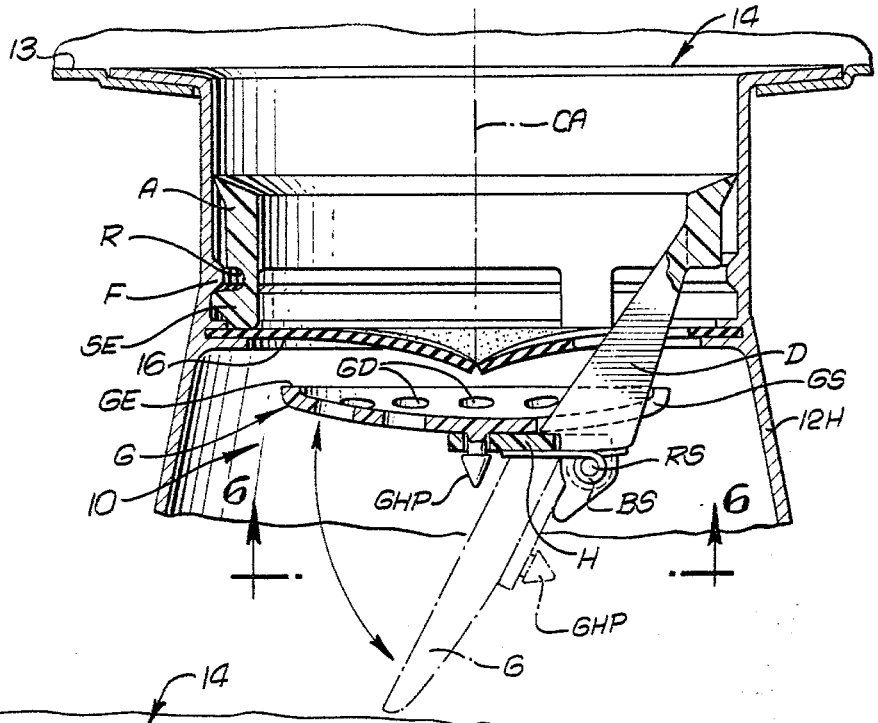
FIG. 4 is a cross-sectional view taken along the line 4—4 of FIG. 3 and with an alternate position of the drain protective device illustrated in dotted outline.

The garbage disposal drain protective device 10 comprises an annular frame member A having a dependent arm D for mounting the guard G thereto. The annular frame member A is provided with a plurality of spaced apart securing elements SE having female securing receptacles R mounted to the bottom side thereof and constructed to be readily snap-locked onto the flange element F for the garbage disposal 12. The annular frame member A may be readily secured to the flange F by anyone without requiring any particular skill and in a minimum amount of time, a few seconds. Alternatively, the annular frame member A may be readily removed from the flange F with the same ease with which it was mounted thereto. The secured snap-locked arrangement of the annular frame A showing the relationship of the securing receptacles R of the securing elements SE with respect to the flange F can be appreciated by examining FIG. 4. The annular frame member A has a dependent arm D arranged on one side thereof and integrally constructed therewith. The dependent arm D is preferably constructed and defined to be inclined toward the central axis CA of the frame member A at a preselected annular relationship so as to mount the guard means G in a plane substantially parallel to the plane of the disposal open end or flange F, see FIG. 4. The guard means G extends adjacent the side walls 12H for the disposal housing and yet spaced therefrom to permit waste material to move through the space between the housing 12H and the edge of the guard means G when properly secured to the flange F, see FIGS. 2, 4 and 5, for example. In this fashion, the guard means G can function to trap utensils and similar large objects inadvertently falling thereon from moving through the disposal 12 to the cutting blades 15 and permitting the object to be retrieved from the guard means G.

Figure 3:
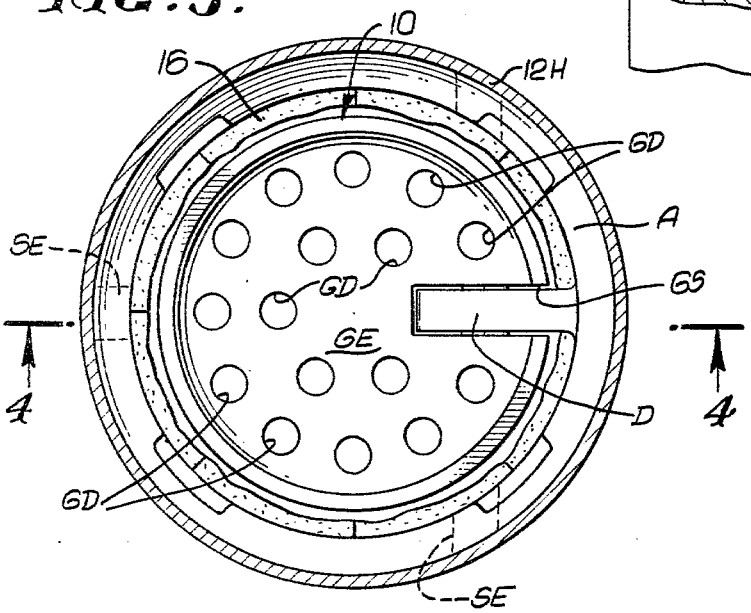
FIG. 3 is a cross-sectional view taken along the line 3—3 of FIG. 2.
Figure 6:
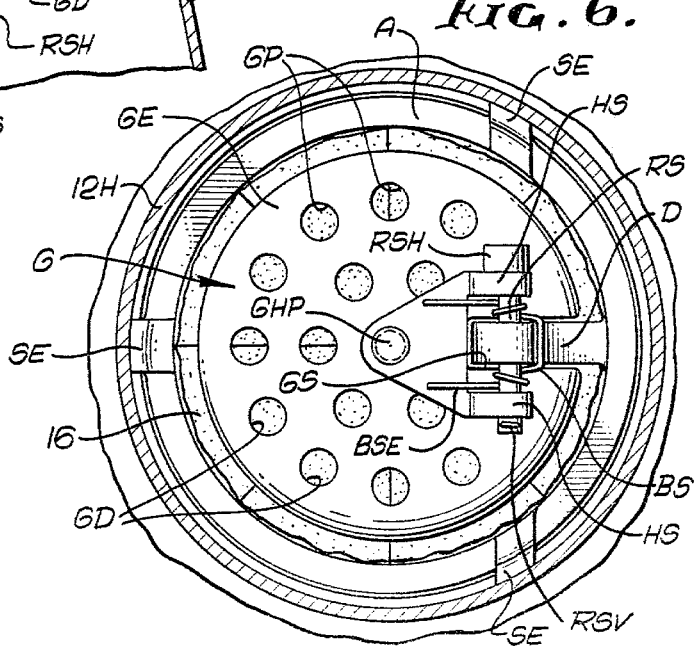
FIG. 6 is a cross-sectional view taken along the line 6—6 of FIG. 4.

The guard means G comprises a disc-shaped or concave element GE that is pivotally mounted to the dependent arm D. The disc-shaped or concave element GE is mounted with the concave surface opening upwardly towards the open end of the housing 12 or towards the frame A for catching the silverware or similar large objects that accidentally pass through the rubber flange 16. The guard element GE is constructed and defined with a plurality of spaced apart drain holes GD that are arranged in a spaced apart relationship on concentric circles on the element GE, as can be appreciated from examining FIGS. 3 and 6, in particular. These holes GD can be arranged in the fashion of a strainer and the holes sized to allow liquids and small objects to pass through the guard element GE. The concave element GE includes a radially extending slot GS which extends from the periphery of the element a preselected distance inwardly along a radial line and terminates adjacent the center of the element, as can be best appreciated from examining FIG. 3. The slot GS is sized to accommodate the dependent arm D which extends through the slot. The bottom surface of the guard element GE is provided with a hinge pin GHP which depends from the center of the bottom side of the guard element GE. The hinge pin GHP has its free end constructed in the form of an arrowhead with a short shaft for snap-locking a hinge thereto whereby the arrowhead end functions as a securing element for a hinge mounted to the shaft; see FIG. 4.

Figure 5:
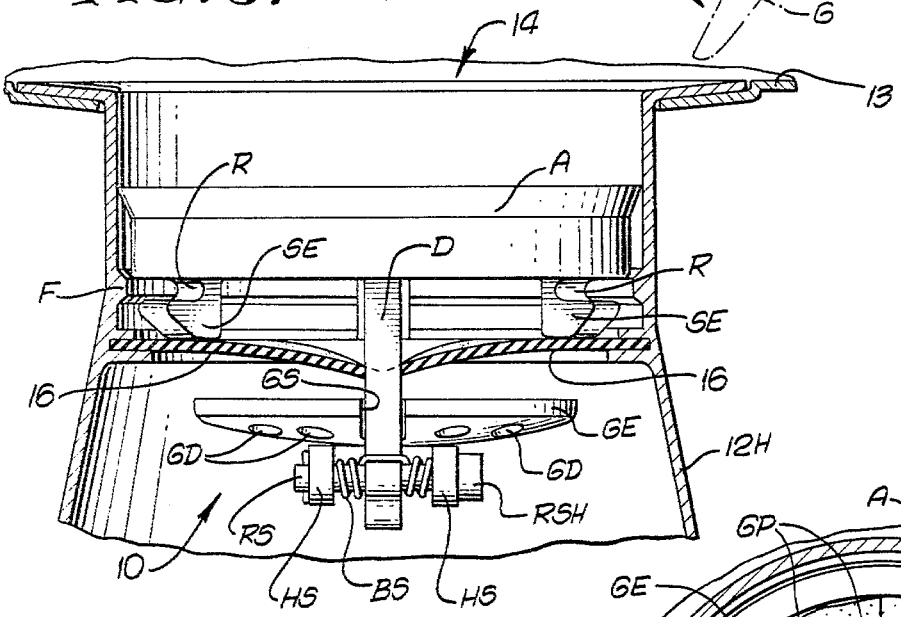
FIG. 5 is a cross-sectional view of the garbage disposal unit with the drain protective device of the present invention illustrated mounted therein from a back side elevation.

A hinge H is provided for pivotably securing the guard element GE to the dependent arm D. The hinge H has a generally U-shaped configuration with the ends of the arms of the U defining a pair of shaft mounting arms HS. Each of the arms HS has an aperture to slidably receive a shaft therethrough. The remaining end of the hinge H is provided with a hinge aperture adjacent the bottom end of the U-shaped hinge H for securing the hinge pin GHP. A shaft RS is mounted to the aligned apertures for the hinge arms HS of the hinge H and a similar aperture is provided adjacent the free end of the dependent arm D to thereby secure the guard element GE to the dependent arm D by means of the hinge H. The shaft RS is defined with an enlarged head portion RSH at one end thereof and an undercut section RSU adjacent the opposite end. A biasing spring BS is secured to the shaft RS to provide the desired mounting position and resilient action for the guard means G. The bias spring BS is constructed of a single piece of wire with a coil section adjacent each end connected with an integral U-shaped section intermediate the coil sections. To this end, the spring BS is arranged on the shaft RS with the coil sections on opposite sides of the dependent arm D and the U-shaped connecting portion formed around the arm; see FIGS. 5 and 6. The free ends BSE of the coiled sections extend outwardly of the shaft RS to lie in engagement with the lower surface of the hinge H; see FIG. 6. It should be noted that in the construction of the spring BS, the coil portion of the spring arranged on the left hand side of the dependent arm D; as illustrated in FIG. 5, is wound in a clockwise direction, while the right hand coil portion is wound in a counter-clockwise direction. This construction of the spring and associated mounting elements is effective for maintaining the guard means G is a plane substantially parallel to the plane of the annular frame member A and which position is referred to as the normal position. Similarly, once the guard means G is moved out of its normal position to a position as illustrated in dotted outline in FIG. 4, it will be returned automatically to its normal position.

Consistent with the concept of providing noncorrosive elements, the principal elements of the protective device 10 can be constructed of plastic. To this end the annular frame member A and its dependent arm D, as well as the guard element GE, the hinge H, and the shaft RS, can all be constructed of a suitable plastic. Only the spring element BS is not constructed of a plastic but preferably should be constructed of a nickel stainless steel or equivalent material.

The operation of the protective device 10 is the same as disclosed in my aforementioned U.S. Pat. No. 4,089,474. Briefly, the garbage disposal unit 12 will operate in its normal fashion for the usual size waste material disposed of in the unit. In this construction, the food or scraps will travel around the guard means G and pass through the space between the interior wall of the housing 12H and the outer edges of the guard means G so as to travel to the cutting blades 15 and be ground up thereby. Small objects and/or liquids may pass through the drainage apertures GD for the guard element GE. In the event a large object, such as silverware, does pass beyond the flanges 16, it will be trapped or caught by the guard means G and may be readily retrieved by inserting a hand into the housing 12H and removing the object from the guard means. In the event there is a large object to be voluntarily disposed of that cannot pass between the guard means G and the side wall of the housing 12H, it is necessary to manually dispose of this object by inserting it into the housing 12H against the spring force of the bias spring BS for the guard means G. This will cause the guard means G to pivot in a counter-clockwise direction out of the path of the object so that the object may travel beyond the guard means G to the cutting blades 15. After the object has been so positioned, the guard means G can be released so that it can automatically return to its normal horizontal guarding position in the housing 12H as a result of the construction of the spring BS. The pivotable movement of the guard means G is sufficient to allow a large object to be positioned into the housing 12H to expose it to the cutters 15 and yet not cause an engagement between the guard means G and the cutting blades 15.

It should now be appreciated by those skilled in the art that the improved protective device 10 will not only function to capture large objects, such as silverware or the like, that may be inadvertently passed into the disposal 12 in accordance with the teachings of my U.S. Pat. No. 4,089,474, but it also can be readily, in a matter of seconds, installed on any conventional garbage disposal unit. Alternatively, the protective device 10 can be just as readily removed from the garbage disposal unit for repairs or the like to the disposal unit, all without interferring with the normal operation of the garbage disposal unit.

What is claimed is:

1. A protective device for a garbage disposal or the like wherein the garbage disposal housing has an open end for receiving waste material to be disposed of by means of the disposal, the open end having an exposed flange extending inwardly of the open end a preselected distance, said protective device comprising an annular frame member having a plurality of spaced apart securing elements extending from one side thereof and adapted to secure the frame member to said flange, said frame member including a dependent arm having a free end extending from the frame member from said one side thereof, and guard means pivotably secured adjacent the free end of the dependent arm adapted to be mounted in a plane substantially parallel to a plane of the said garbage disposal housing's open end and adapted to extend adjacent the side walls of the housing and yet spaced therefrom to be able to permit waste material to move through the space between the housing and the edge of the guard means when the annular frame member is to be secured to the exposed flange of the housing, the guard means is adapted to normally function to trap utensils and similar large objects inadvertently falling thereon from moving through the disposal's open end to the cutting blades thereof and yet being manually pivotable out of the path of a large object placed in the open end of the housing and moved against the guard element so as to pivot it out of its normal position to allow the object to be moved beyond the guard means to the cutting blades and upon being released from the large object it automatically pivots to its normal position.

2. A protective device for a garbage disposal as defined in claim 1 wherein the guard means is constructed with a concave curvature and with the concavity mounted facing the open end of the garbage disposal housing.

3. A protective device for a garbage disposal as defined in claim 1 or 2 wherein the guard means is provided with a multiplicity of spaced apart apertures.

4. A protective device for a garbage disposal as defined in claim 1 or 2 wherein the annular frame member and the guard means are constructed of a hard plastic material.

5. A protective device for a garbage disposal as defined in claim 1 wherein the guard means comprises means for yieldably mounting the guard means to the dependent arm to permit it to swing counterclockwise with respect to said arm.

6. A protective device for a garbage disposal as defined in claim 5 wherein the guard means is of a circular configuration with a dependent mounting element arranged centrally of one side thereof and having a notch on one side thereof adapted to accommodate the dependent arm, said mounting means comprising hinge means secured to the dependent mounting element and a shaft secured to the hinge means and the arm for permitting the guard means to pivot away from said arm by means of the notch for the guard means.

7. A protective device for a garbage disposal as defined in claim 1 wherein said dependent arm is constructed and defined to be inclined toward the central axis of the frame member at a preselected angular relationship.

8. A protective device for a garbage disposal adapted to be mounted to a disposal housing, said protective device comprising, an annular frame member having a plurality of spaced apart securing elements extending from one side thereof and adapted to secure the frame member to a disposal housing in a preselected plane, said frame member including a dependent arm having a free end extending from the frame member from said one side thereof, and guard means pivotably secured adjacent the free end of the dependent arm to be normally mounted in a plane substantially parallel to the preselected plane of the frame member and being pivotal in a direction away from the said parallel plane and away from the frame member.

9. A protective device for a garbage disposal as defined in claim 8 wherein the frame member and the guard means are constructed and defined by means of a plastic material.

10. A protective device for a garbage disposal as defined in claim 8 or 9 wherein the guard means includes a plurality of spaced apart liquid draingage apertures extending therethrough sized for permitting liquids and small objects to drain therethrough.

11. A protective device for a garbage disposal as defined in claim 8 or 9 wherein the guard means is of a concave shape with the concavity mounted facing the frame member.

12. A protective device for a garbage disposal as defined in claim 8 wherein the guard means includes hinge means secured thereto and resilient means interconnecting the hinge means and the dependent arm adjacent thereto, said resilient means normally maintaining the guard means in said plane.

13. A protective device for a garbage disposal as defined in claim 12 wherein the resilient means comprises spring wire means constructed with a plurality of wire wound coils on one end wound in one direction and a plurality of wire wound coils on the other end wound in a direction opposite to said one direction and with a U-shaped section of the coiled wire arranged intermediate the coiled ends and connected with each wound coil.

14. A protective device for a garbage disposal as defined in claim 8 wherein said dependent arm is constructed and defined to extend from the frame member at a preselected angular relationship with respect to the central axis of the frame member.

15. A protective device for a garbage disposal as defined in claim 8 wherein the frame securing elements comprise snap-lock securing elements.

16. A protective device for a garbage disposal as defined in claim 15 wherein the securing elements have a female securing receptacle.

* * * * *